US009231333B2

(12) United States Patent
Endo et al.

(10) Patent No.: US 9,231,333 B2
(45) Date of Patent: Jan. 5, 2016

(54) ELECTRIC CONNECTOR HAVING A LANCE SUPPORTED BY A RESILIENT SUPPORT WITH A SLIT AND DISENGAGEABLE BY A JIG

(71) Applicant: DAI-ICHI SEIKO CO., LTD., Kyoto (JP)

(72) Inventors: Takayoshi Endo, Shizuoka (JP); Sakai Yagi, Shizuoka (JP); Masaru Senmyou, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 8 days.

(21) Appl. No.: 14/293,214

(22) Filed: Jun. 2, 2014

(65) Prior Publication Data

US 2014/0370757 A1 Dec. 18, 2014

(30) Foreign Application Priority Data

Jun. 18, 2013 (JP) ..... 2013-127822

(51) Int. Cl.

*H01R 13/42* (2006.01)
*H01R 13/516* (2006.01)
*H01R 43/20* (2006.01)
(Continued)

(52) U.S. Cl.

CPC ..... *H01R 13/516* (2013.01); *H01R 13/422* (2013.01); *H01R 13/4223* (2013.01); *H01R 43/20* (2013.01); *H01R 43/22* (2013.01); *H01R 13/4361* (2013.01); *Y10T 29/5313* (2015.01)

(58) Field of Classification Search

CPC .. H01R 13/42; H01R 13/4364; H01R 13/422; H01R 13/436
USPC ..... 439/595, 752, 626
See application file for complete search history.

(56) References Cited

U.S. PATENT DOCUMENTS 5,187,862 A 2/1993 Ohsumi
6,692,302 B1 2/2004 Tsuji et al.
(Continued)

FOREIGN PATENT DOCUMENTS

EP 1 291 980 3/2003
JP 4-95366 3/1992
(Continued)

OTHER PUBLICATIONS

European Search Report (ESR) issued Oct. 22, 2014 in corresponding European Patent Application No. EP 14 17 1082.

*Primary Examiner* — Chandrika Prasad
(74) *Attorney, Agent, or Firm* — Wenderoth, Lind & Ponack, L.L.P.

(57) ABSTRACT

An electric connector includes an electrically insulative housing, and a terminal having an engagement section and inserted into a terminal space formed in the housing in a direction from a rear towards a front of the housing. The housing includes a lance protruding in the housing towards an axis of the terminal space, and is able to engage to and disengage from the engagement section of the terminal. A resilient support resiliently supports the lance such that the lance is able to move away from the axis, and a path is provided through which a jig for disengaging the lance from the engagement section is inserted into the housing through a front of the housing towards the lance along the engagement section. The resilient support is formed with a slit communicating with the path and extending towards the lance from an entrance of the path.

16 Claims, 14 Drawing Sheets

(51) Int. Cl.

| | |
|---|---|
| ***H01R 13/422*** | (2006.01) |
| ***H01R 43/22*** | (2006.01) |
| *H01R 13/436* | (2006.01) |

(56) References Cited

U.S. PATENT DOCUMENTS

| | | | | |
|---|---|---|---|---|
| 2002/0127914 | A1* | 9/2002 | Yamamoto | 439/595 |
| 2006/0141863 | A1* | 6/2006 | Sakamoto | 439/595 |
| 2007/0054546 | A1 | 3/2007 | Higuchi | |
| 2011/0111639 | A1 | 5/2011 | Hara et al. | |
| 2012/0021633 | A1* | 1/2012 | Ito | 439/304 |
| 2014/0193989 | A1* | 7/2014 | Kutsuna et al. | 439/155 |

FOREIGN PATENT DOCUMENTS

| | | |
|---|---|---|
| JP | 2003-157922 | 5/2003 |
| JP | 2004-39414 | 2/2004 |
| JP | 2004-39498 | 2/2004 |
| JP | 2004-247227 | 9/2004 |
| JP | 2011-103193 | 5/2011 |
| JP | 2013-69537 | 4/2013 |
| KR | 2008-0020835 | 3/2008 |

* cited by examiner

ELECTRIC CONNECTOR HAVING A LANCE SUPPORTED BY A RESILIENT SUPPORT WITH A SLIT AND DISENGAGEABLE BY A JIG

BACKGROUND OF THE INVENTION

1. Field of the Invention

The invention relates to an electric connector equipped in a wire harness for electrically connecting a circuit board and the wire harness to each other. The invention relates further to a housing employed in the electric connector, and to a jig used for the electric connector and the housing for disengaging a lance from a terminal.

2. Description of the Related Art

FIG. 14 illustrates a conventional electric connector 500, FIG. 15 is a cross-sectional view of the electric connector 500 viewed in a direction of an arrow D shown in FIG. 14, and FIG. 16 is another cross-sectional view of the electric connector 500 viewed in a direction of the arrow D shown in FIG. 14.

As illustrated in FIG. 12, the conventional electric connector 500 includes a housing 50 composed of an electrically insulative material, and a plurality of terminals 60 to be inserted in a direction from a rear to a front of the housing 50 into terminal spaces 51 formed in the housing 50.

Each of the terminals 60 includes a sheath section 61 having a square cylindrical cross-section and formed at a front in a direction in which the terminal 60 is inserted into the housing 50, and a wire compression section 62 formed at a rear in the above-identified direction. A core wire (not illustrated) exposed out of a cover of a cable 63 is fixed in the wire compression section 62 in a compressed condition to thereby electrically connect the cable 63 and the terminal 60 to each other. Each of the terminals 60 is formed at a front end of the sheath section 61 with an engagement section 64 protruding away from an axis 61*c* of the sheath section 61.

Each of the terminal spaces 51 formed in the housing 50 is formed therein with a lance 53 protruding towards an axis 51*c* of the terminal space 51, and a resilient support 54 supporting the lance 53 such that the lance 53 is able to be deformed towards and away from the axis 51*c* of the terminal space 51. As illustrated in FIGS. 14 and 15, the terminal 60 is inserted into the housing 50 through a rear opening 51*b* of the terminal space 51 formed at the rear of the housing 50, and then, is pushed into the housing 50. After the engagement section 64 slided along the lance 53 and passed over the lance 53, the engagement section 64 is engaged with the lance 53. Thus, the terminal 60 is fixed in the terminal space 51.

In the case that there occurs a defect in electric connection in the electric connector 500, for instance, the terminal 60 is necessary to be pulled out of the housing 50, in which case, it is necessary to disengage the engagement section 64 and the lance 53 from each other. A jig 70 in the form of a thin plate is used to do so. As illustrated in FIG. 15, the jig 70 is inserted into the housing 50 towards a rear of the housing 50 through an opening 55 formed adjacent to a front opening 51*a* of the terminal space 51 formed at a front of the housing 50. Then, as illustrated in FIG. 16, the jig 70 is downwardly pushed at a proximal end 70*b* thereof. The jig 70 lifts up a part of the resilient support 54 through a distal end (an insertion portion) 70*a* thereof moving in the counter direction under the principles of the lever and fulcrum to thereby cause the resilient support 54 to be deformed upwardly, resulting in that the lance 53 is released from the engagement section 64. Then, the terminal 60 can be pulled out of the housing 50 through the rear opening 51*b* of the terminal space 51.

Japanese Patent Application Publication No. 2004-39498 suggested a connector including a lance supported at front and rear ends thereof. A part of the lance forwardly protruding an engagement surface is designed to be branched into two sections.

Japanese Patent Application Publication No. 2004-247227 suggested a connector including a lance supported at front and rear ends thereof, and designed to be deformable around the front and rear ends. There is formed a space between a terminal and a front of the lance. A disengagement portion of a jig can be inserted into the space.

Recently, an electric connector is required to have a small size and a low height. Accordingly, the partition wall 56 defining the terminal spaces 51 in the housing 50 and the resilient support 54 supporting the lance 53 are designed to be thin, and the opening 55 through which the jig 70 is inserted into the housing 50 is designed to be small.

However, if the opening 55 were designed to be small in response to the requirement of designing an electric connector to be small in both a size and a height, a part for forming the opening 55 in an injection mold used for molding the housing 50 has to be thin, resulting in that the injection mold might be deformed and/or damaged. Furthermore, if the opening 55 were designed to be small, the distal end 70*a* of the jig 70 to be inserted into the housing 50 through the opening 55 has to be designed to be thin, resulting in the reduction in a strength of the jig 70.

The above-mentioned problems are found also in the above-mentioned Publications, but remain unsolved.

SUMMARY OF THE INVENTION

In view of the above-mentioned problems in the conventional electric connectors, it is a first object of the present invention to provide an electric connector capable of avoiding an injection mold used for making a connector housing from being deformed and/or damaged, and further of avoiding reduction in a strength of a jig used for disengaging a lance and a terminal from each other.

It is a second object of the present invention to provide a housing suitable for the above-mentioned electric connector.

It is a third object of the present invention to provide a jig used in the above-mentioned electric connector and jig for disengaging a lance and a terminal from each other, having an enhanced strength and providing enhance workability.

In one aspect of the present invention, there is provided an electric connector including an electrically insulative housing, and a terminal having an engagement section and inserted into a terminal space formed in the housing in a direction from a rear towards a front of the housing. The housing includes a lance protruding in the housing towards an axis of the terminal space, and is able to engage to and disengage from the engagement section of the terminal. A resilient support resiliently supports the lance such that the lance is able to move away from the axis, and a path through which a jig for disengaging the lance from the engagement section is inserted into the housing through a front of the housing towards the lance along the engagement section. The resilient support is formed with a slit communicating with the path and extending towards the lance from an entrance of the path.

The electric connector in accordance with the present invention makes it possible to use the slit as well as the path as a space into which the jig is inserted. Thus, it is now possible to use a jig having a shape insertable into a space extending to the slit from the path, and to avoid reduction in a strength of the jig. Furthermore, a part for defining the path and a part for defining the slit can be formed integral with each other in a die assembly used for molding the housing, ensuring that it is possible to avoid thin parts, and thus, it is possible to avoid the parts from being deformed and/or damaged. In addition, since the jig can be inserted into a point in the vicinity of the lance, it is possible to enhance an efficiency with which the lance is disengaged from the housing.

It is preferable that the slit extends to the engagement section of the terminal inserted into the terminal space or to a location in the vicinity of the engagement section of the terminal inserted into the terminal space.

By so designing the slit, it is possible to insert the jig into a location in the vicinity of the engagement section of the terminal, it is possible to enhance an efficiency with which the lance is disengaged from the housing.

For instance, the path and the slit may be designed to be T-shaped or reverse T-shaped. By designing the path and the slit to be T-shaped or reverse T-shaped, the jig can have a greater strength than that of the conventional jig including a plate having a rectangular cross-section and being to be inserted into a housing through the path.

It is preferable that the lance includes an inclined surface higher in a direction towards a front from a rear of the housing, the jig inserted into the housing through the path making contact at a front end thereof with the inclined surface of the lance.

It is preferable that the resilient support includes a surface facing an axis of the terminal space, the surface defining an inclined surface higher in a direction towards a rear from a front of the housing.

In another aspect of the present invention, a housing is used for an electric connector into which a terminal including an engagement section is inserted, the housing being electrically insulative. The housing includes therein a terminal space into which the terminal is inserted in a direction towards a front from a rear of the housing, and includes a lance protruding in the housing towards an axis of the terminal space, and is able to engage to and disengage from the engagement section of the terminal. A resilient support resiliently supports the lance such that the lance is able to move away from the axis, and a path is provided through which a jig for disengaging the lance from the engagement section is inserted into the housing through a front of the housing towards the lance along the engagement section. The resilient support is formed with a slit communicating with the path and extending towards the lance from an entrance of the path.

In still another aspect of the present invention, a jig is used for disengaging a lance from an engagement section of a terminal in the above-mentioned electric connector or in the above-mentioned housing. The jig includes an insertion portion inserted into the housing through the path, and the insertion portion has a T-shaped cross-section insertable into both the path and the slit.

By designing the insertion portion to be T-shaped, the jig can have a greater strength than that of the conventional jig including a plate having a rectangular cross-section, and can be inserted into a housing through the path.

It is preferable that the insertion portion has a height greater than a height of an entrance opening of the terminal space.

Even if an attempt was made to insert the jig into the housing through an entrance opening of the terminal space, since the insertion portion could not be inserted into the entrance opening of the terminal space, a mistake in insertion can be avoided. Furthermore, it is possible to prevent the terminal from being damaged due to such a mistake in insertion.

It is preferable that the insertion portion includes a first portion horizontally coextensive and being in the form of a plate, and a second portion vertically extending from the first portion.

It is preferable that the first portion has at a front end thereof a downwardly inclined surface.

The advantages obtained by the aforementioned present invention will be described hereinbelow.

The present invention makes it possible to avoid an injection mold (a die assembly) used for making a connector housing from being deformed and/or damaged, and further, to avoid reduction in a strength of a jig used for disengaging a lance and a terminal from each other, ensuring that an efficiency with which a lance is disengaged from a terminal can be enhanced.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

First Embodiment

An electric connector 100 in accordance with the first embodiment is explained hereinbelow with reference to FIGS. 1 to 9.

As illustrated in FIGS. 1, 2 and 4-7, the electric connector 100 includes a housing 10 composed of an electrically insulative material and defining a plurality of terminal spaces 11 extending in parallel with one another in the housing 10, and a plurality of terminals 20 each to be inserted into a respective one of the terminal spaces 11 in a direction X from a rear towards a front of the housing 10.

Figure 6:
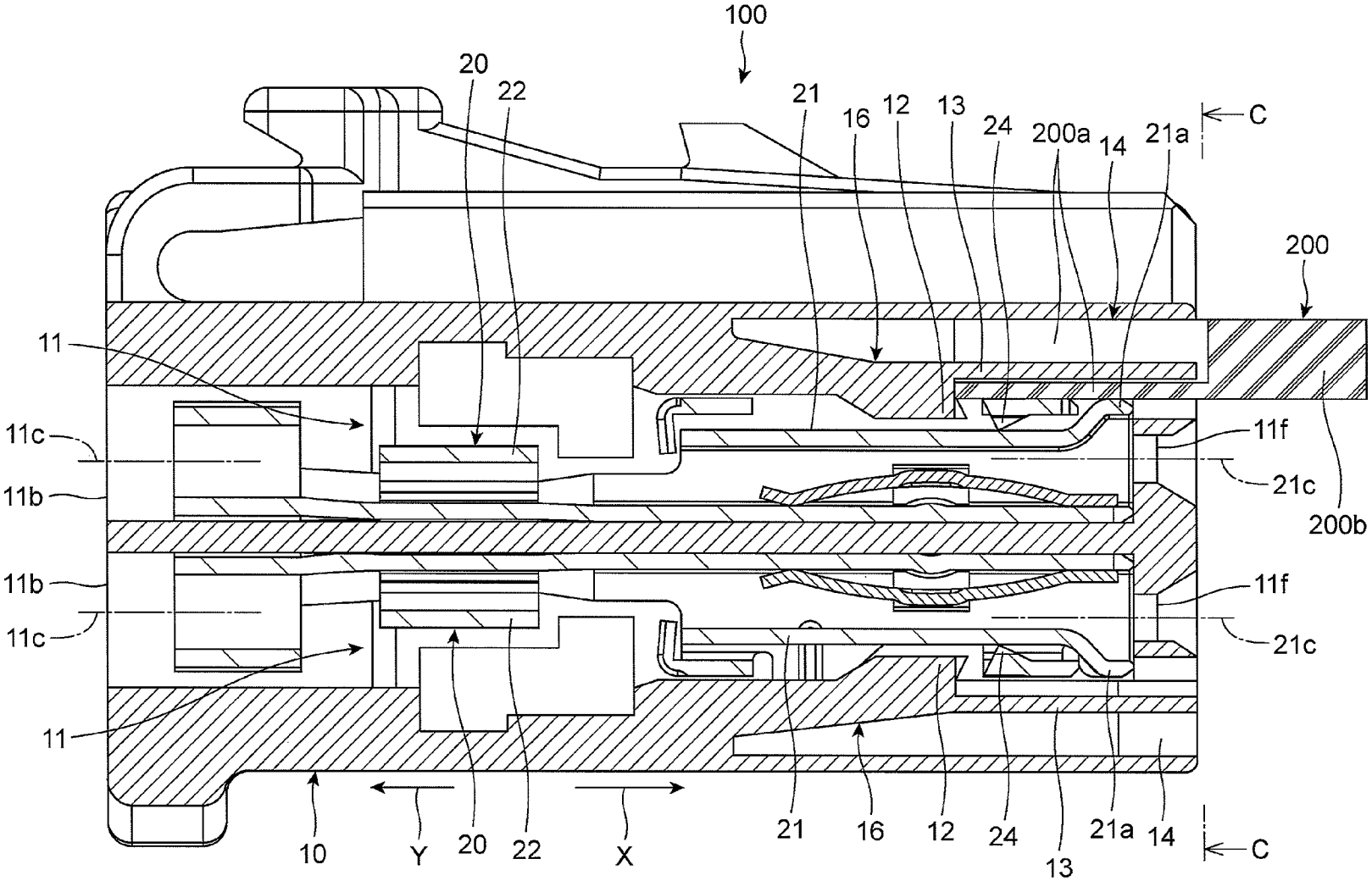
FIG. 6 is a cross-sectional view taken along the line A-A in FIG. 5.
Figure 7:
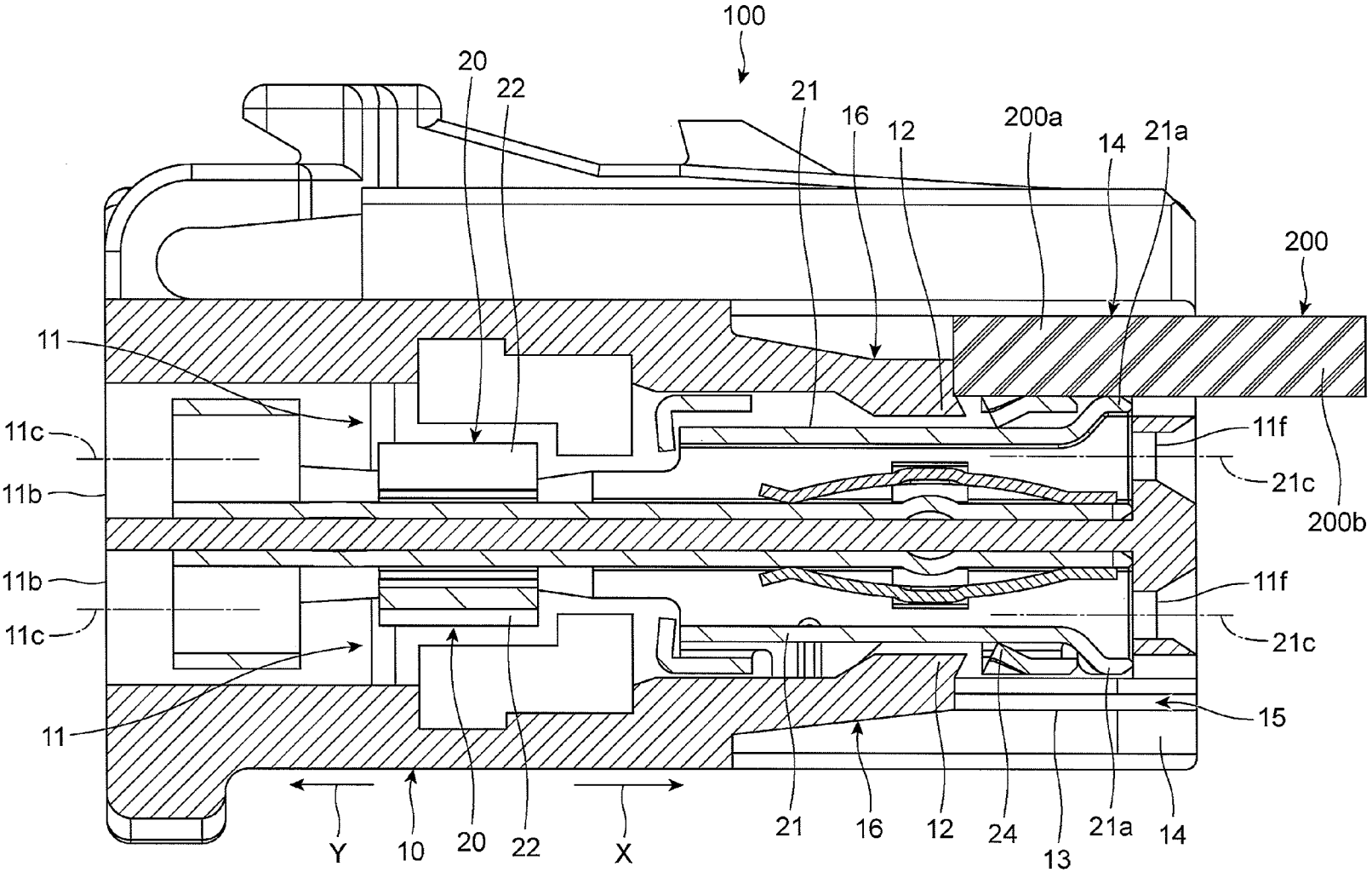
FIG. 7 is a cross-sectional view taken along the line B-B in FIG. 5.
Figure 8:
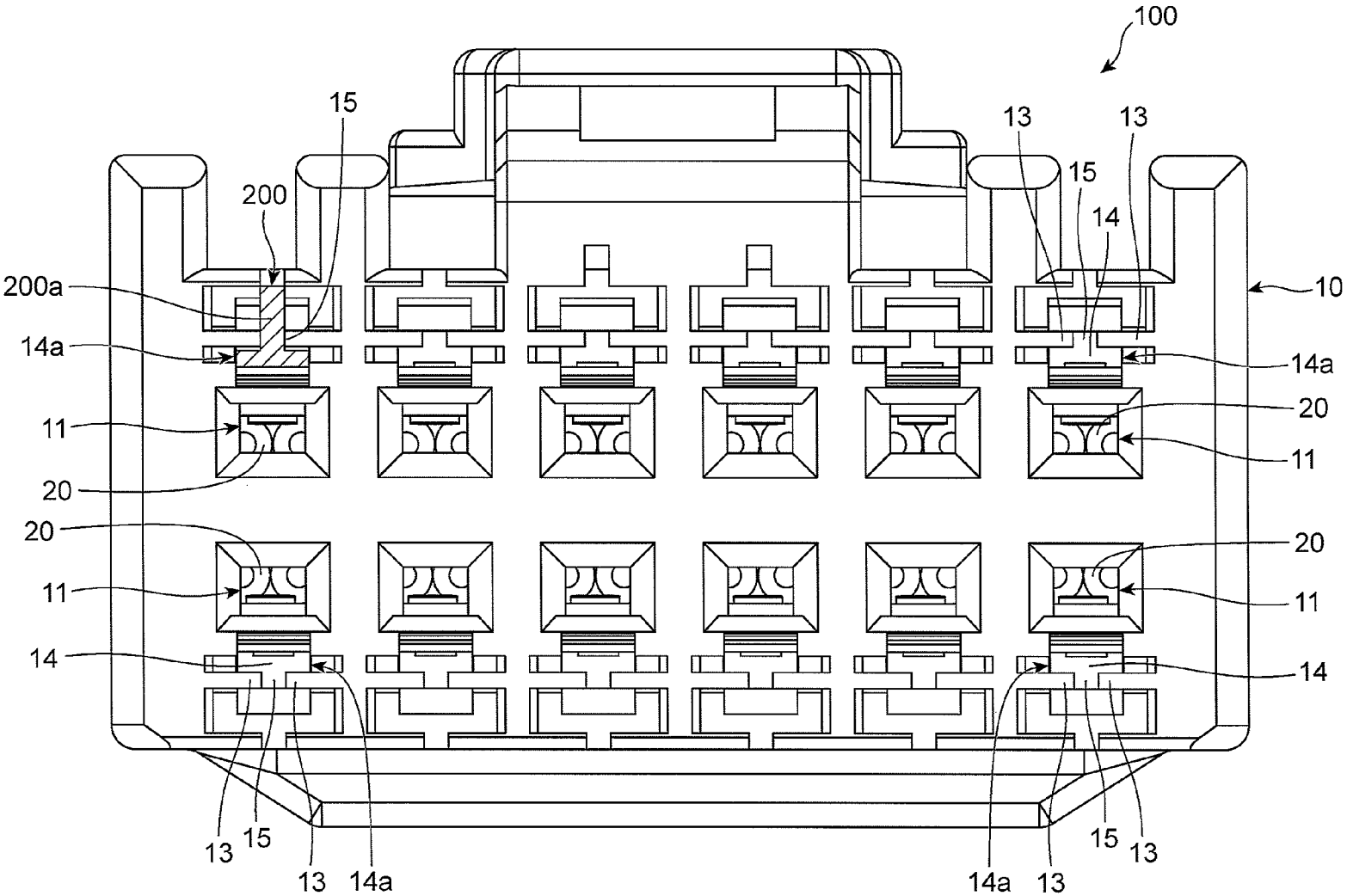
FIG. 8 is a cross-sectional view taken along the line C-C in FIG. 6.

As illustrated in FIGS. 6 and 7, each of the terminals 20 includes a sheath section 21 having a square cylindrical cross-section and formed at a front in a direction X in which the terminal 20 is inserted into the housing 10, and a wire compression section 22 formed at a rear in the direction X. A core wire (not illustrated) exposed out of a cover of a cable is fixed in the wire compression section 22 in a compressed condition to thereby electrically connect the cable and the terminal 20 to each other. Each of the terminals 20 is formed at a front end of the sheath section 21 with an engagement section 24 protruding towards an axis 21*c* of the sheath section 21.

The housing 10 includes a lance 12 protruding towards an axis 11*c* of the terminal space 11, and configured to be engaged to and disengaged from the engagement section 24 of the terminal 20, a resilient support 13 supporting the lance 12 such that the lance 12 can be resiliently deformed in a direction away from the axis 11*c* of the terminal space 11, and a path 14 through which a jig 200 can be inserted into the terminal space 11 through a front of the housing 10 towards the lance 12 along the engagement section 24. The jig 200 is used for disengaging the lance 12 and the terminal 20 from each other. The resilient support 13 is formed on or integral with a partition wall 16 partitioning the housing 10 into a plurality of the terminal spaces 11.

As illustrated in FIGS. 6 and 7, the terminal 20 is inserted into the housing 10 through a rear opening 11*b* of the terminal space 11, and then, is pushed further into the housing 10 in the direction X. Thus, the engagement section 24 of the terminal 20 and the lance 12 protruding into the terminal space 11 push each other to thereby cause the resilient support 13 supporting the lance 12 to be deformed. The engagement section 24 slides across the lance 12 with the lance 12 being deformed in a direction away from the axis 11*c*. When the engagement section 24 passes over the lance 12, the lance 12 returns to its original position by virtue of a resilient reaction force exerted by the resilient support 13. Thus, the lance 12 and the engagement section 24 face each other in a direction of the axis 11*c*, and so, the terminal 20 remains engaged in the terminal space 11, even if the terminal 20 is pulled in a direction opposite to the direction X.

Figure 1:
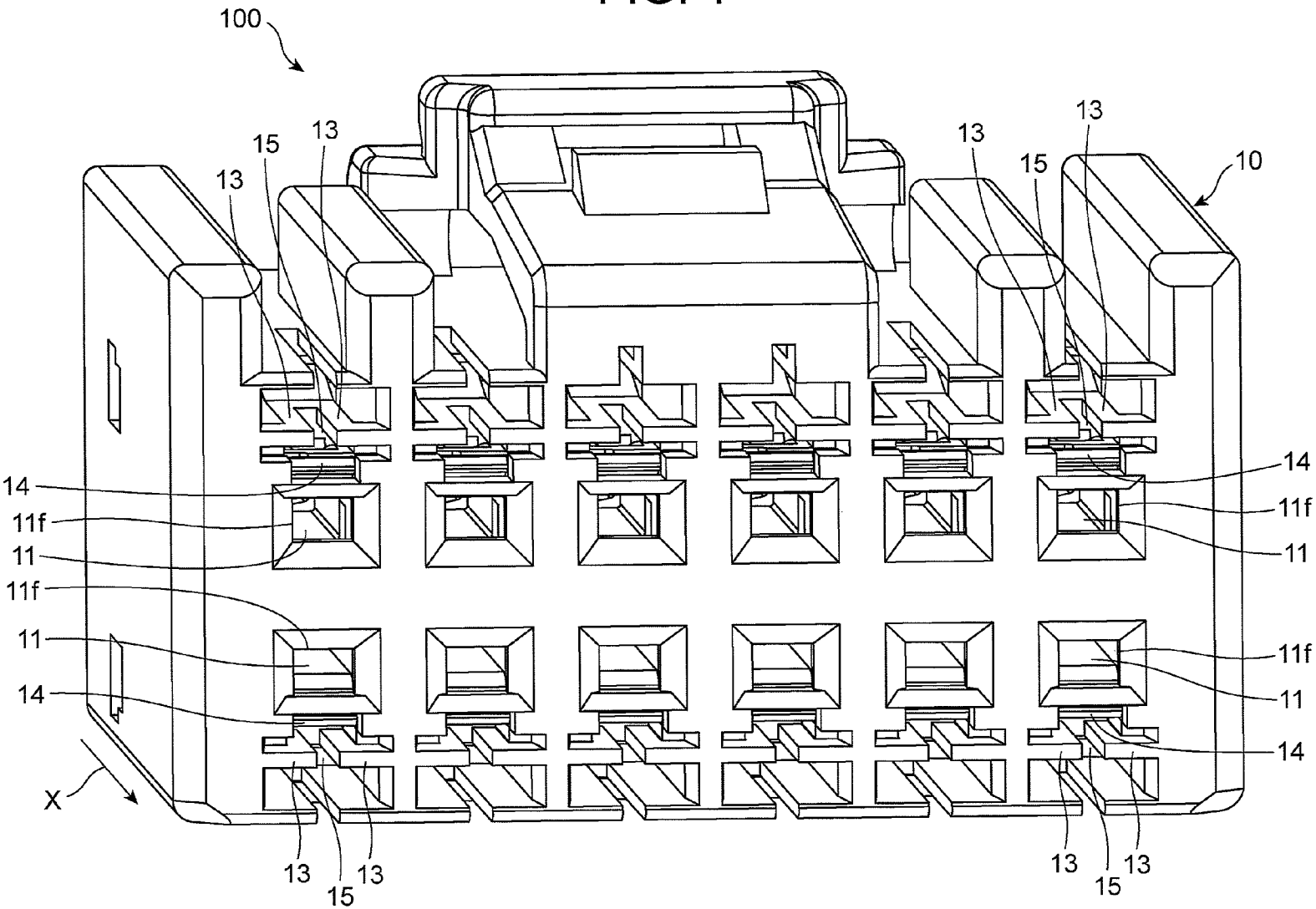
FIG. 1 is a front perspective view of the electric connector in accordance with the first embodiment of the present invention.
Figure 2:
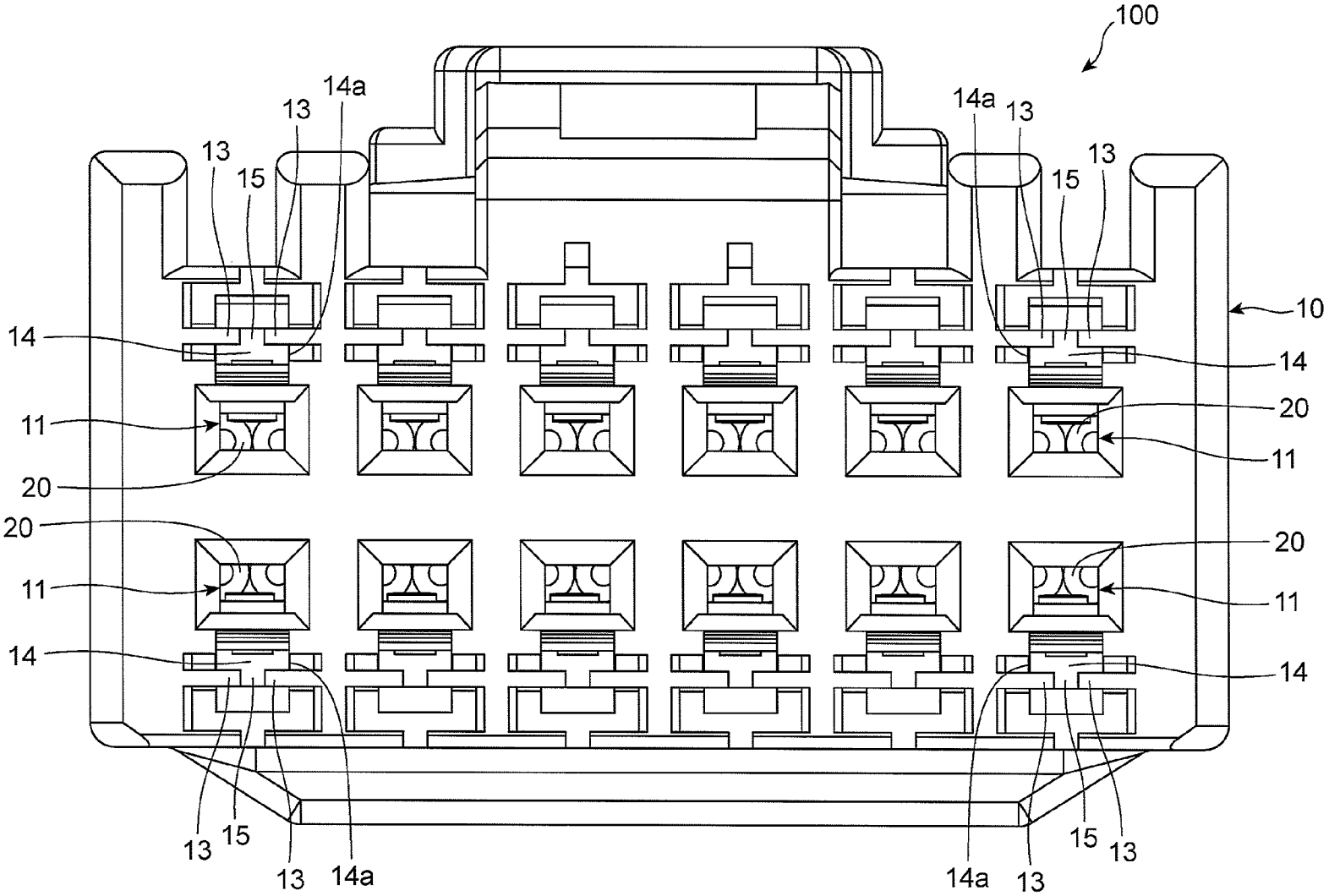
FIG. 2 is a front view of the electric connector illustrated in FIG. 1.
Figure 4:
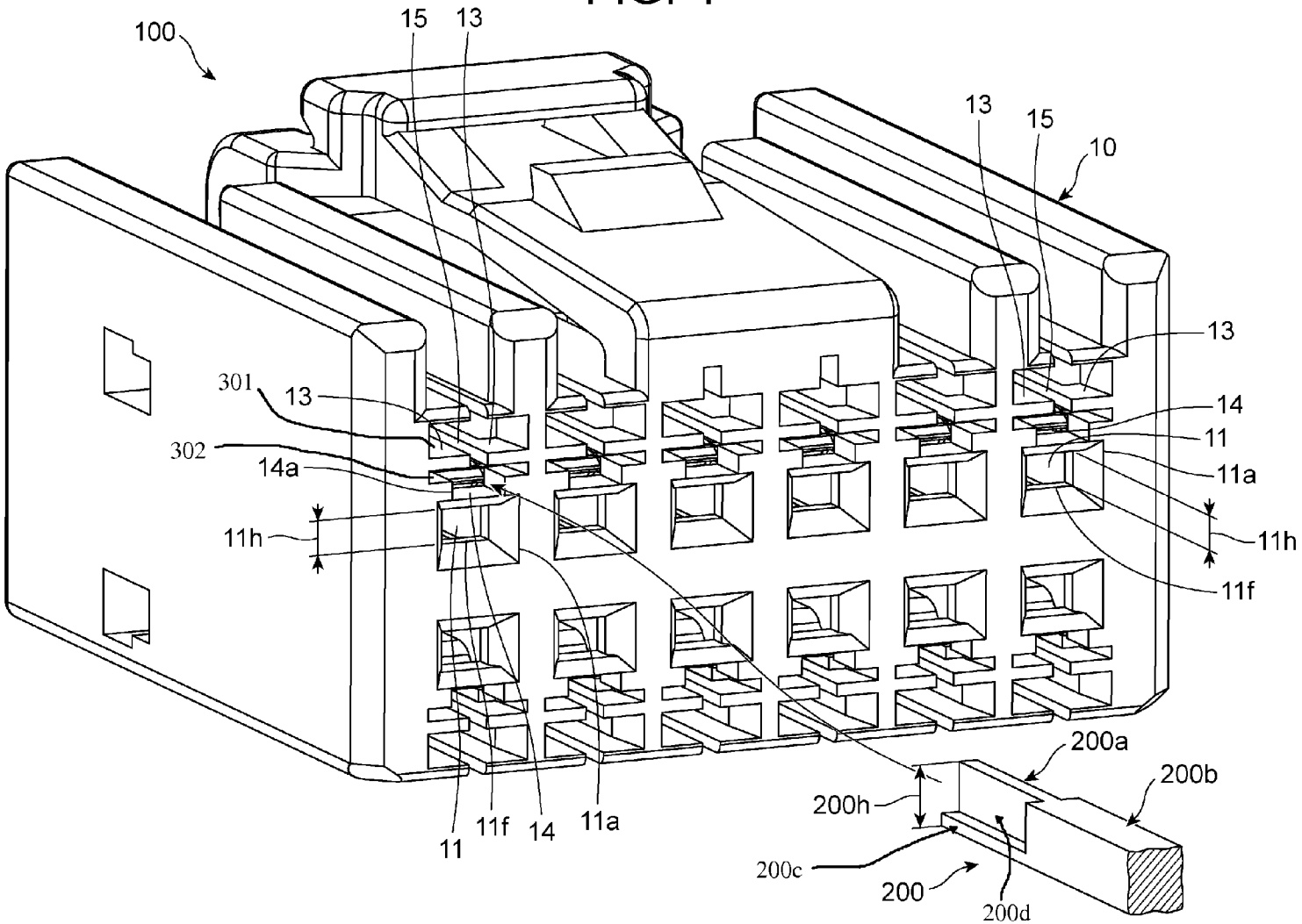
FIG. 4 is a perspective view illustrating that the jig illustrated in FIG. 3 is inserted into the electric connector illustrated in FIG. 1.

As illustrated in FIGS. 1 and 2, the resilient support 13 is formed with a slit 15 being continuous with the path 14 and extending from an entrance 14*a* of the path 14 to the lance 12. As shown in FIG. 4, the path 14 has a first space 301 and a second space 302 with the slit 15 therebetween (the resilient support 13 being located between the first space 301 and the second space 302). Thus, as also shown in FIG. 4, the first space 301, slit 15, second space 302, and terminal space 11 are arranged in this order either top-to-bottom or bottom-to-top.

Figure 3:
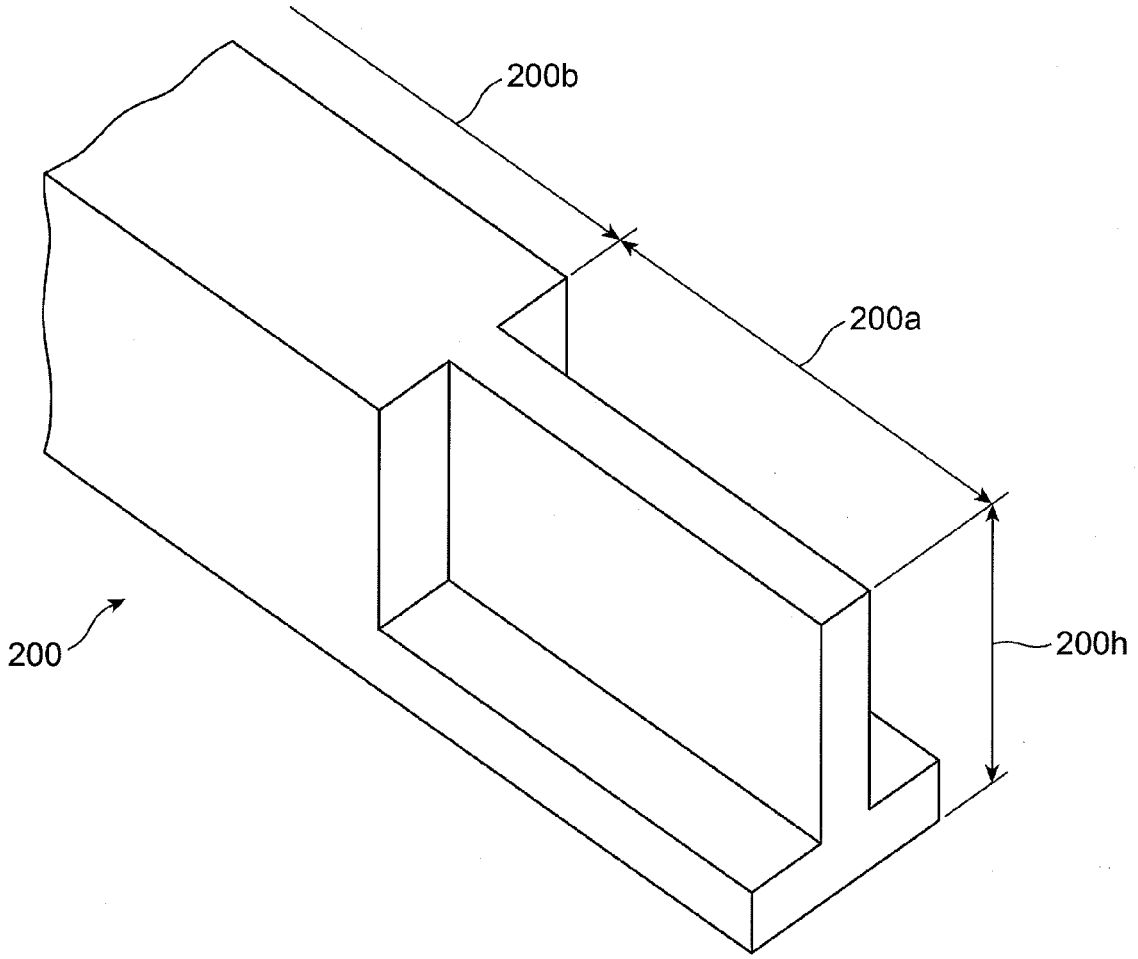
FIG. 3 is a partial perspective view of a jig employed in the electric connector illustrated in FIG. 1.

As illustrated in FIGS. 3 and 4, the jig 200 is used for disengaging the lance 12 from the terminal 20. The jig 200 includes an insertion portion 200*a* having a shape insertable into the path 14 and the slit 15, and a handle portion 200*b* held by a user when the lance 12 is disengaged from the terminal 20 through the use of the jig 200. In addition, the jig 200 includes a horizontal portion 200*c* to be inserted into the second space 302, and a vertical portion 200*d* to be inserted into the slit 15 and the first space 301. As also shown in FIG. 4, the width of the horizontal portion 200*c* is equal to the largest width of the jig 200, while the vertical portion 200*d* has a height equal to the largest height of the jig 200. The insertion portion 200*a* has a T-shaped cross-section formed by the horizontal portion 200*c* and the vertical portion 200*d* so that the insertion portion 200*a* can be inserted into both the first space 301 and the second space 302 of the path 14 and the slit 15. The handle portion 200*b* has a square cross-section, but may be designed to have a polygonal, circular or elliptical cross-section.

Figure 14:
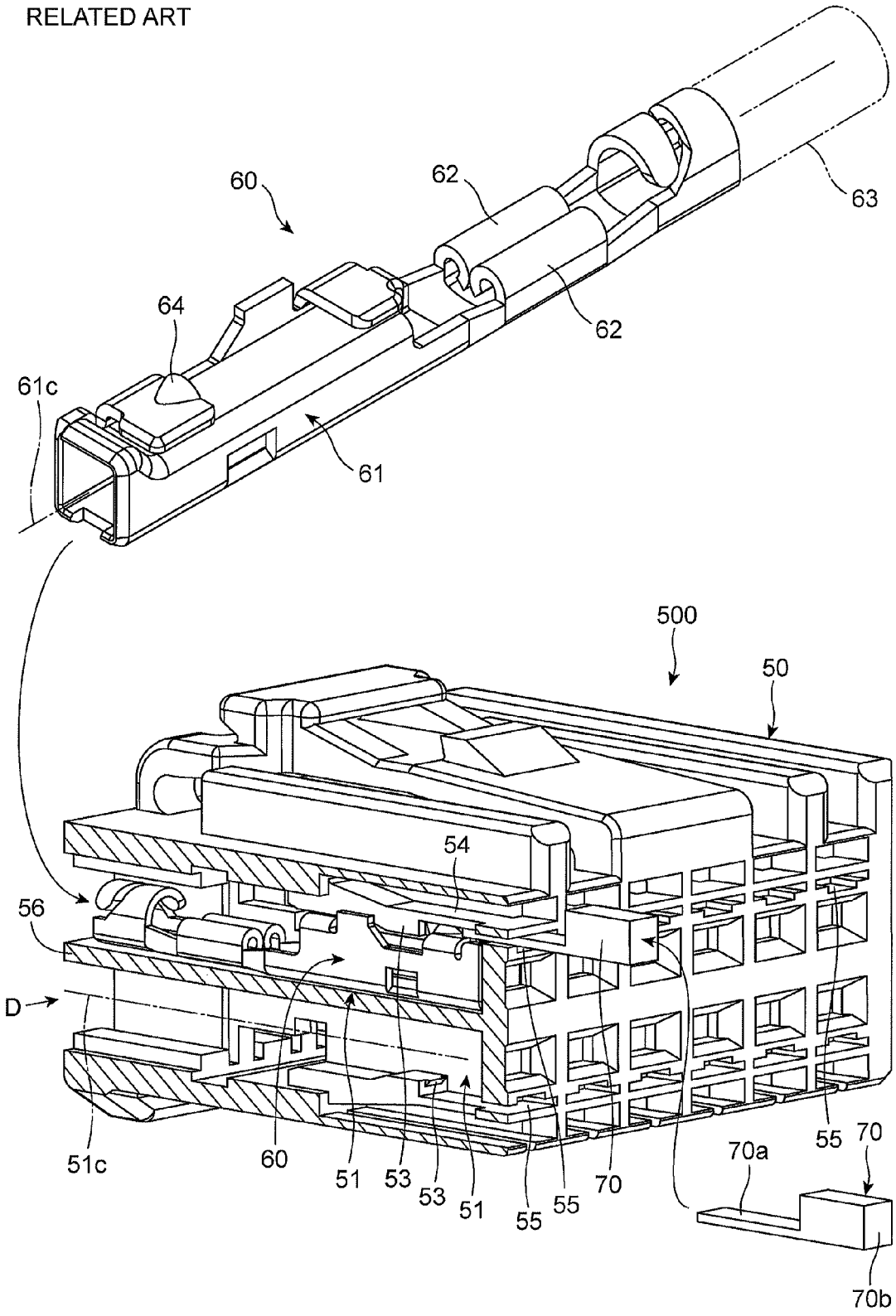
FIG. 14 is a cross-sectional perspective view of the conventional electric connector.
Figure 15:
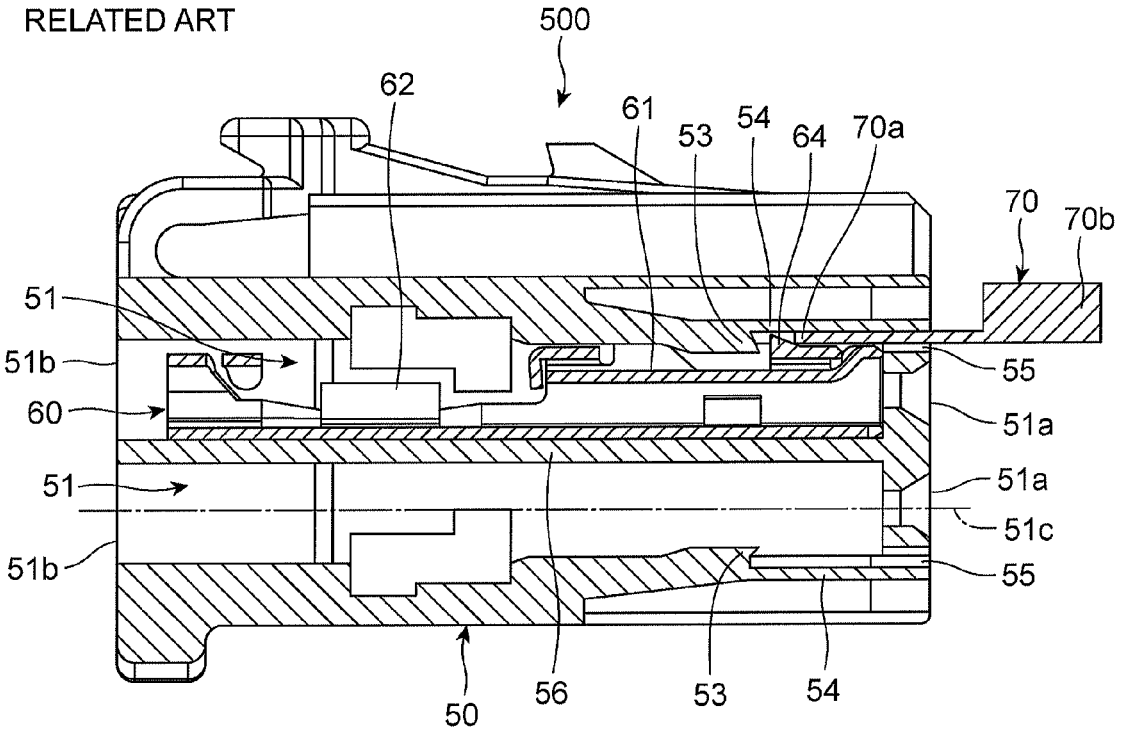
FIG. 15 is a cross-sectional view of the electric connector illustrated in FIG. 14, viewed in a direction indicated with an arrow D shown in FIG. 14.
Figure 16:
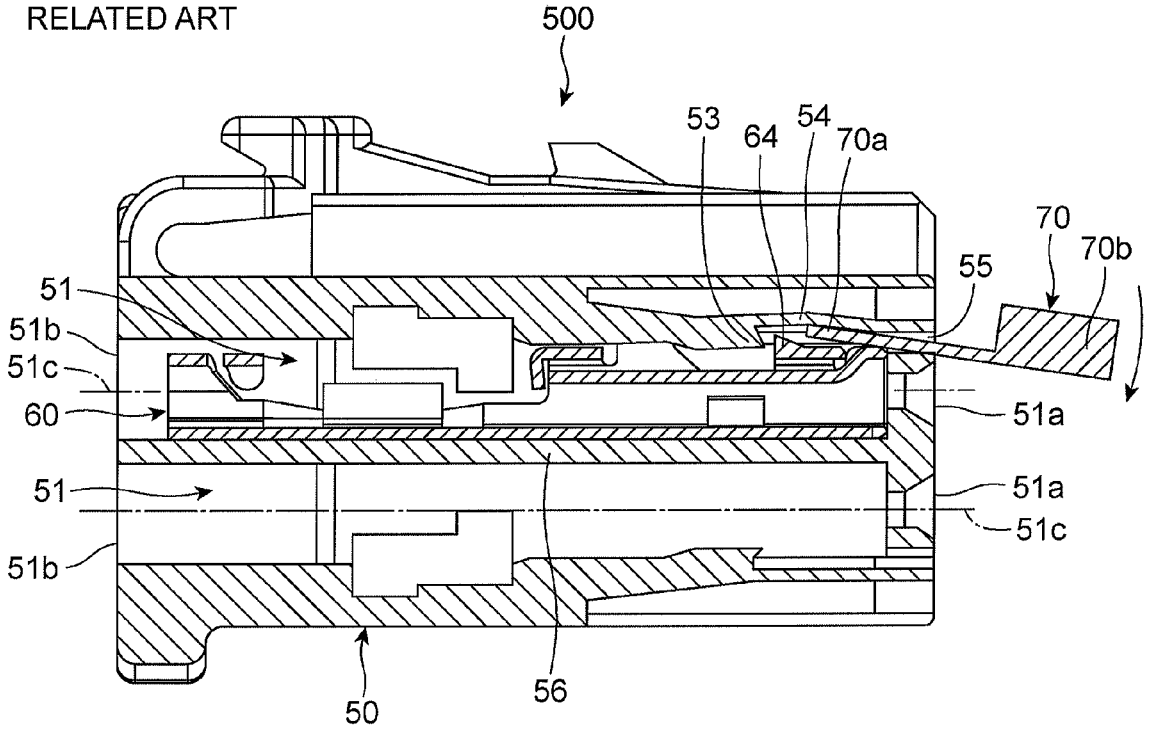
FIG. 16 is a cross-sectional view of the electric connector illustrated in FIG. 14, viewed in a direction indicated with an arrow D shown in FIG. 14.

Since the insertion portion 200*a* of the jig 200 has a T-shaped cross-section, the jig 200 can have a strength greater than the conventional jig 70 (see FIG. 14) including the insertion portion 70*a* having a rectangular cross-section, that is, being in the form of a plate. Furthermore, the jig 200 provides better workability in steps of disengaging the lance 12 from the terminal 20.

In the electric connector 100 illustrated in FIGS. 1 and 2, it is possible to use not only the path 14, but also the slit 15 as a space into which the jig 200 is inserted. Thus, it is now possible to use the jig 200 including the insertion portion 200*a* having a T-shaped cross-section, as illustrated in FIG. 3, ensuring that the jig 200 can be prevented from the reduction in a strength. Furthermore, a part for defining the path 14 and a part for defining the slit 15 can be formed integral with each other in a die assembly used for molding the housing 10, ensuring it possible to prevent the parts from being thin, and thus, it is possible to prevent the parts from being deformed and/or damaged. In addition, since the jig 200 can be inserted into a point in the vicinity of the lance 12, it is possible to enhance an efficiency with which the lance 12 is disengaged from the terminal 20.

Hereinbelow is explained steps of disengaging the lance 12 from the terminal 20 in the electric connector 100.

In the case of a defect in electrical connection in the electric connector 100, for instance, it is necessary to pull the terminal 20 out of the housing 10 to repair the terminal 20 or change the terminal 20 into a new one, in which case, since it is necessary to disengage the engagement section 24 of the terminal 20 inserted into the terminal space 11 from the lance 12, the jig 200 illustrated in FIG. 3 is used to do so.

Figure 5:
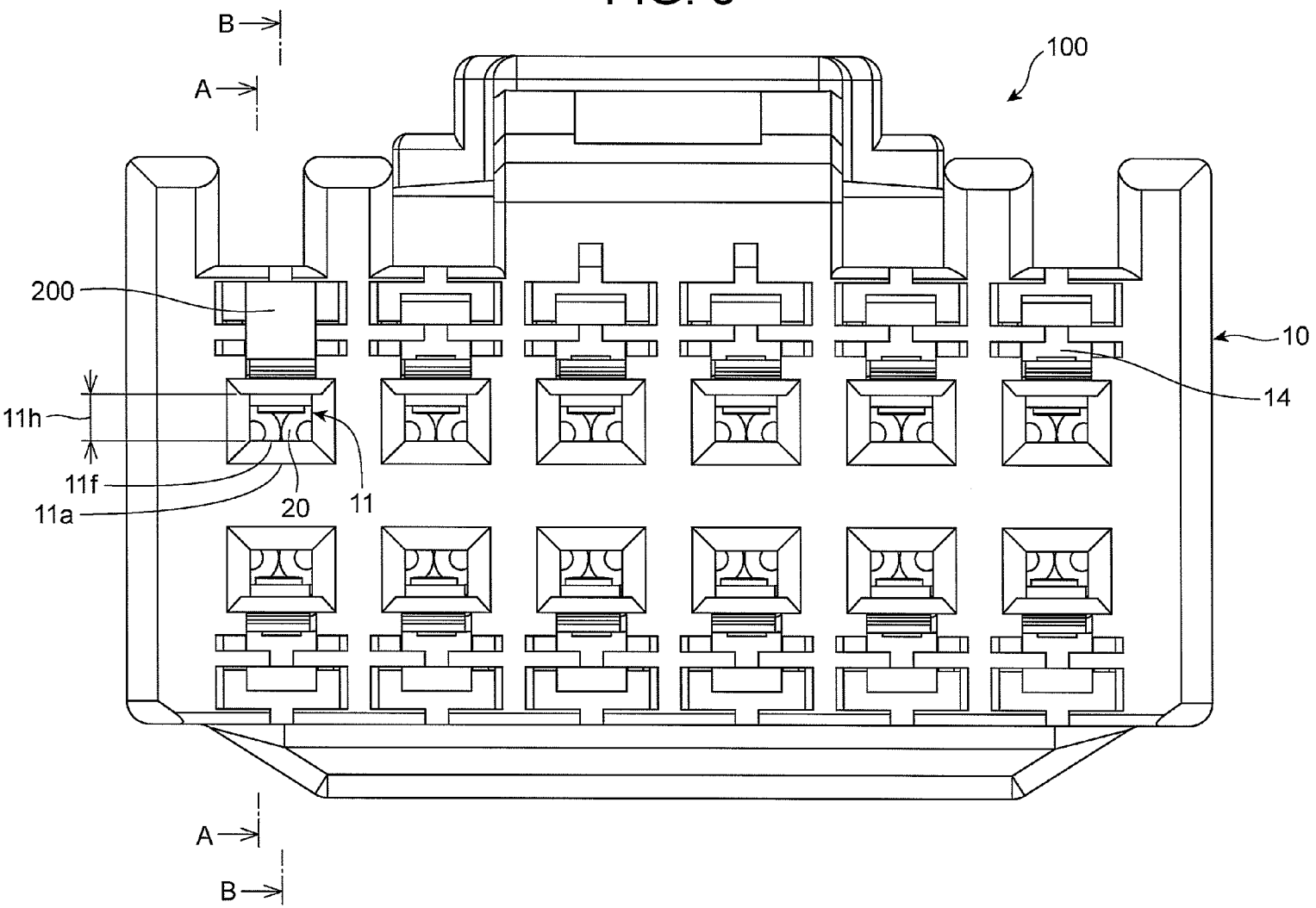
FIG. 5 is a front view illustrating that the jig illustrated in FIG. 3 is inserted into the electric connector illustrated in FIG. 1.

As illustrated in FIG. 4, the jig 200 is inserted at the insertion portion 200*a* thereof into the terminal space 11 towards a rear of the housing 10 through an entrance opening 14*a* of the path 14 located adjacent to a front opening 11*a* of the terminal space 11. Then, as illustrated in FIG. 5, the insertion portion 200*a* of the jig 200 is caused at a front end thereof to make contact with a front of the lance 12 (see FIGS. 6 and 7).

Then, the jig 200 is inclined such that the handle portion 200*b* goes towards the axis 11*c* of the terminal space 11, resulting in that the insertion portion 200*a* moves in a direction opposite to a direction in which the handle portion 200*b*, that is, obliquely upwardly, around a front upper edge 21*a* of the terminal 20 acting as a fulcrum, under the principles of the lever and fulcrum. The upwardly moving insertion portion

200*a* lifts up a portion of the resilient support 13 to thereby cause the resilient support 13 to be upwardly deformed, resulting in that the lance 12 moves away or is disengaged from the engagement section 24 of the terminal 20. Then, the terminal 20 can be taken out of the terminal space 11 through a rear opening 11*b* of the terminal space 11 by pulling the terminal 20 in a direction Y opposite to the direction X in which the terminal 20 is inserted into the terminal space 11.

As mentioned earlier, in the housing 10 of the electric connector 100, it is possible to use both of the path 14 and the slit 15 as a space into which the jig 200 is inserted. Thus, it is now possible to use the jig 200 including the insertion portion 200*a* having a shape insertable into a space extending to the slit 15 from the path 14, and to avoid reduction in a strength of the jig 200. Furthermore, a part for defining the path 14 and a part for defining the slit 15 can be formed integral with each other in a die assembly used for molding the housing 10, ensuring that it is possible to prevent the parts from being thin, and thus, it is possible to prevent the parts from being deformed and/or damaged. In addition, since the jig 200 can be inserted into a point in the vicinity of the lance 12, it is possible to enhance an efficiency with which the lance 12 is disengaged from the terminal 20.

As illustrated in FIG. 4, the insertion portion 200*a* of the jig 200 is designed to have a height 200*h* greater than a height of an entrance opening 11*f* of the terminal space 11.

Figure 9:
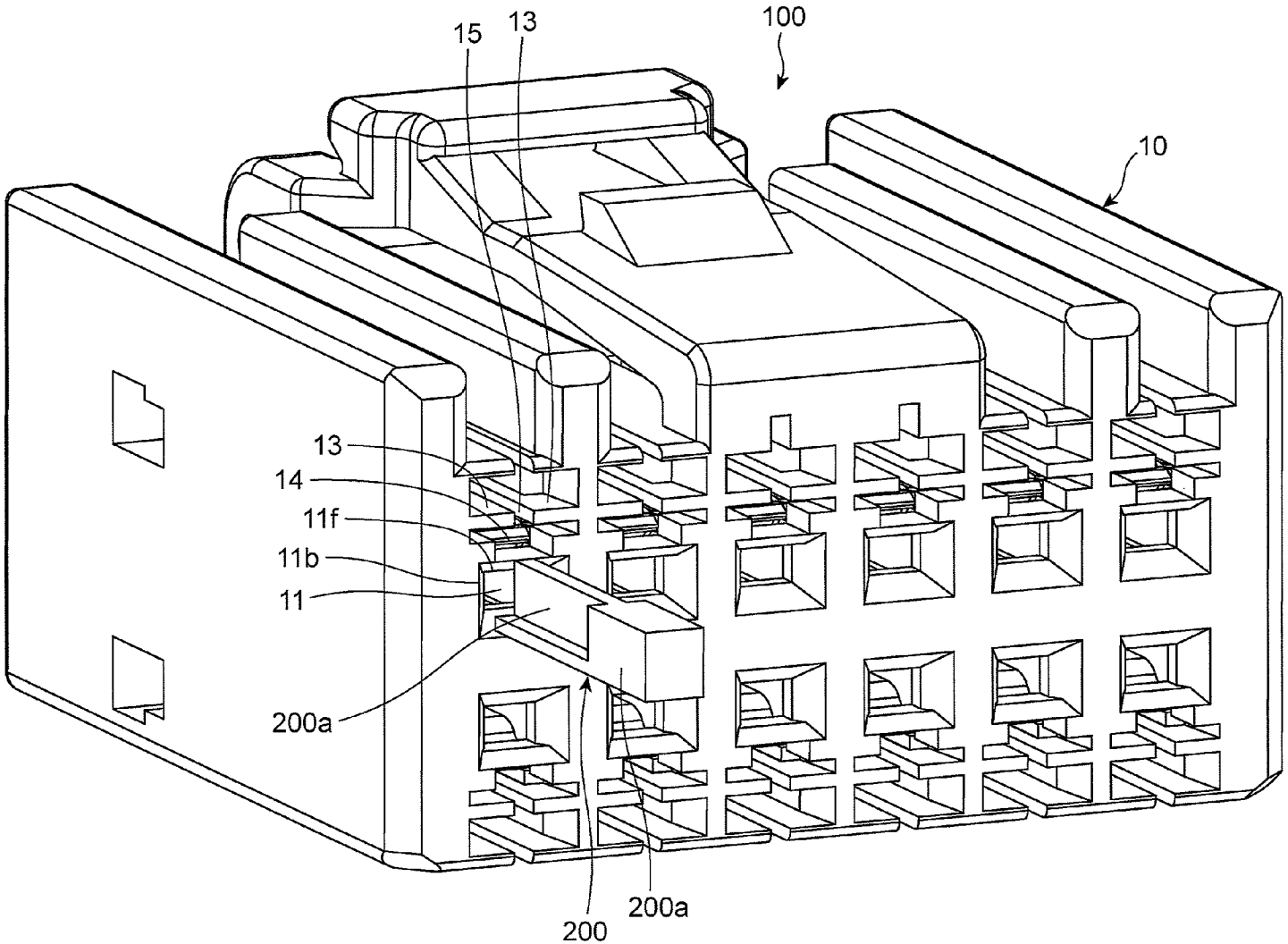
FIG. 9 is a perspective view illustrating that the jig illustrated in FIG. 3 is attempted to be wrongly inserted into the electric connector illustrated in FIG. 1.

Consequently, as illustrated in FIG. 9, even if an attempt was made to insert the jig 200 into the housing 10 through the entrance opening 11*f* of the terminal space 11 when the jig 200 is inserted into the path 14, the jig 200 cannot be inserted into the housing 10, because the insertion portion 200*a* could not be inserted into the entrance opening 11*f* of the terminal space 11. Thus, a mistake in insertion can be avoided. Furthermore, it is possible to avoid the terminal 20 housed in the terminal space 11 (see FIG. 8) from being damaged due to such a mistake in insertion.

Second Embodiment

Figure 10:
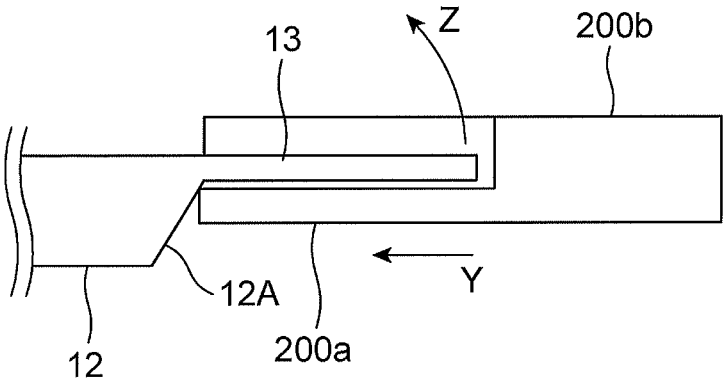
FIG. 10 is a partial cross-sectional view of the lance and the jig in the electric connector in accordance with the second embodiment of the present invention.

FIG. 10 is a partial cross-sectional view of the lance 12 and the jig 200 in the electric connector in accordance with the second embodiment of the present invention.

As illustrated in FIG. 10, the lance 12 in the second embodiment is designed to have an inclined surface 12A higher in a direction (a direction opposite to the direction Y) towards a front from a rear of the housing 10. In other words, the inclined surface 12A obliquely inclines relative to a horizontal direction.

The jig 200 inserted into the terminal space 11 through the path 14 and the slit 15 makes contact at a front end of the insertion portion 200*a* with the inclined surface 12A of the lance 12. As the jig 200 is pushed in the direction Y, the lance 12 is lifted up in a direction Z, and thus, the lance 12 is disengaged from the terminal 20.

It is necessary to swing the jig 200 around the front upper edge 21*a* of the terminal 20 acting as a fulcrum in the electric connector 100 in the first embodiment. In contrast, it is no longer necessary to swing the jig 200 around the front upper edge 21*a* of the terminal 20 in the second embodiment, unlike the first embodiment.

Third Embodiment

Figure 11:
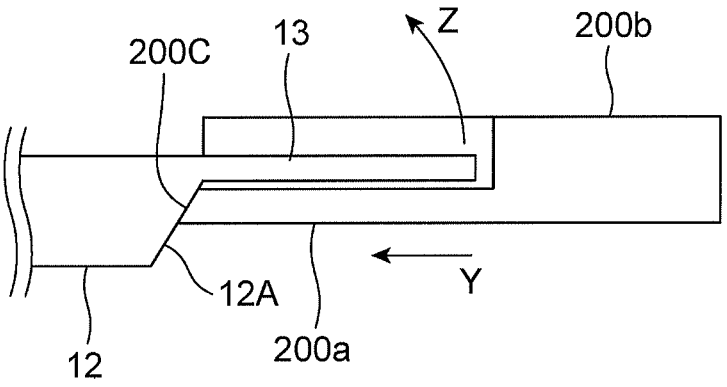
FIG. 11 is a partial cross-sectional view of the lance and the jig in the electric connector in accordance with the third embodiment of the present invention.
Figure 12:
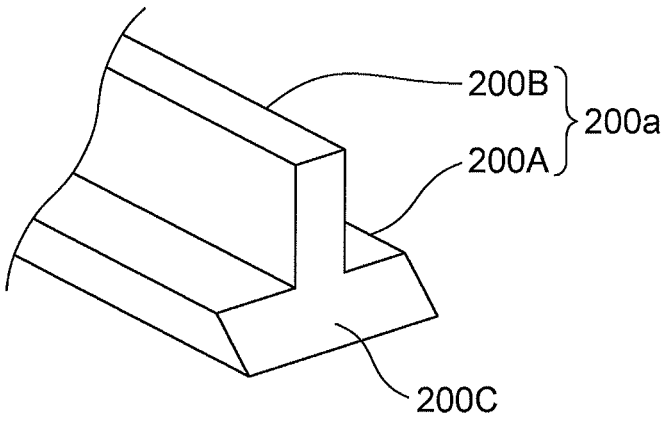
FIG. 12 is a perspective view illustrating the jig used in the electric connector in accordance with the third embodiment of the present invention.

FIG. 11 is a partial cross-sectional view of the lance 12 and the jig 200 in the electric connector in accordance with the third embodiment of the present invention, and FIG. 12 is a perspective view illustrating the jig used in the third embodiment.

As illustrated in FIG. 12, the insertion portion 200*a* of the jig 200 includes a first portion 200A horizontally coextensive and being in the form of a plate, and a second portion 200B vertically extending from the first portion 200A. The first portion 200A and the second portion 200B are T-shaped when horizontally viewed. The first portion 200A is designed to include a front end 200C having a downwardly inclined surface.

As illustrated in FIG. 11, the insertion portion 200*a* of the jig 200 makes contact at the front end 200C with the inclined surface 12A of the lance 12. Since the front end 200*c* of the insertion portion 200*a* and the inclined surface 12A of the lance 12 both incline, they can have a sufficient contact with each other.

It is preferable that an inclined angle of the front end 200C and an inclined angle of the inclined surface 12A are identical with each other.

Fourth Embodiment

Figure 13:
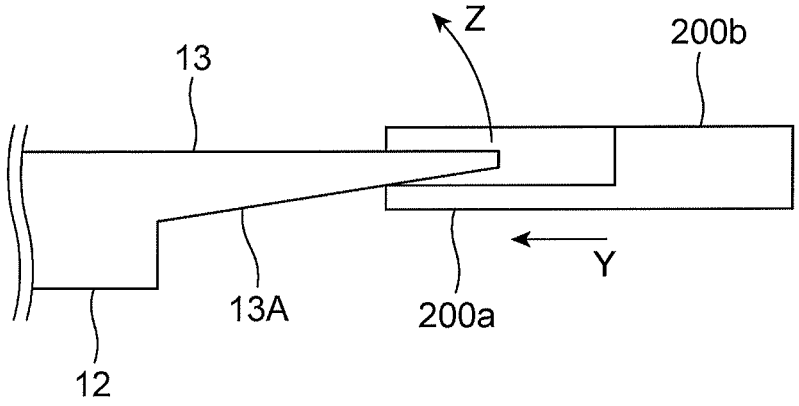
FIG. 13 is a partial cross-sectional view of the lance and the jig in the electric connector in accordance with the fourth embodiment of the present invention.

FIG. 13 is a partial cross-sectional view of the lance 12 and the jig 200 in the electric connector 100 in accordance with the fourth embodiment of the present invention.

As illustrated in FIG. 13, the resilient support 13 in the fourth embodiment is designed to include a lower surface 13A defining an inclined surface higher in a direction towards a front from a rear of the housing (that is, a direction opposite to the direction Y).

The jig 200 inserted into the terminal space 11 through the path 14 and the slit 15 makes contact at a front end of the insertion portion 200*a* with the inclined surface 13A of the resilient support 13. As the jig 200 is pushed in the direction Y, the resilient support 13 and hence the lance 12 are lifted up in a direction Z, and thus, the lance 12 is disengaged from the terminal 20.

Similarly to the second embodiment, it is no longer necessary to swing the jig 200 around the front upper edge 21*a* of the terminal 20, unlike the first embodiment.

The jig 200 illustrated in FIG. 12 may be used in the fourth embodiment.

INDUSTRIAL APPLICABILITY

The electric connector and the housing both in accordance with the present invention are able to be used broadly in various fields such as electric electronic device industries and an automobile industry, as a connector for electrically connecting a circuit board and a wire harness to each other. The jig for disengaging a lance from a terminal, in accordance with the present invention, can also be used in steps of fabricating the electric connector.

While the electric connector 100, the housing 10 and the jig 200 in accordance with the present invention have been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-127822 filed on Jun. 18, 2013 including specification, claims, drawings and summary is incorporated herein by reference in its entirety.

What is claimed is:

1. An electric connector comprising:

an electrically insulative housing; and a terminal having an engagement section and inserted into a terminal space formed in said housing in a direction from a rear of said housing towards a front of said housing, said housing including:

a lance protruding in said housing towards an axis of said terminal space, and configured to engage to and disengage from said engagement section of said terminal;

a resilient support resiliently supporting said lance such that said lance is movable in a direction away from said axis; and a path through which a jig for disengaging said lance from said engagement section is inserted into said housing from the front of said housing towards said lance along said engagement section, wherein said resilient support has a slit communicating with said path and extending towards said lance from an entrance of said path;

wherein said path has a first space and a second space, said slit being located between said first space and said second space; and wherein said first space, said slit, said second space, and said terminal space are arranged within said housing in order as recited in one of a first direction from a top of said housing to a bottom of said housing or a second direction from said bottom of said housing to said top of said housing.

2. The electric connector as set forth in claim 1, wherein said slit extends to said engagement section of said terminal inserted into said terminal space or to a location in a vicinity of said engagement section of said terminal inserted into said terminal space.

3. The electric connector as set forth in claim 1, wherein said path and said slit are T-shaped or reverse T-shaped.

4. The electric connector as set forth in claim 1, wherein said lance includes an inclined surface higher in a direction towards a front of said housing from the rear of said housing, said lance being configured such that the jig inserted into said housing through said path makes contact at a front end thereof with said inclined surface of said lance.

5. The electric connector as set forth in claim 1, wherein said resilient support includes a surface facing the axis of said terminal space, said surface defining an inclined surface higher in a direction towards the rear of said housing from the front of said housing.

6. A jig used for disengaging a lance from an engagement section of a terminal in the electric connector defined in claim 1, said jig including an insertion portion inserted into said housing through said path, said insertion portion having a horizontal portion and a vertical portion arranged to have a T-shaped cross-section;

wherein said horizontal portion is configured to be inserted into said second space of said path, and said vertical portion is configured to be inserted into said first space of said path; and wherein said horizontal portion has a width equal to a largest width of said jig, and said vertical portion has a height equal to a largest height of said jig.

7. The jig as set forth in claim 6, wherein said insertion portion has a height greater than a height of an entrance opening of said terminal space.

8. The jig as set forth in claim 6, wherein said horizontal portion has a plate shape, and said vertical portion extends vertically from said horizontal portion.

9. The jig as set forth in claim 8, wherein said horizontal portion has at a front end thereof a downwardly inclined surface.

10. The electric connector as set forth in claim 1, wherein said resilient support is arranged to separate said first space of said path from said second space of said path, said slit being formed in said resilient support to allow said first space to communicate directly with said second space via said slit.

11. A housing of an electric connector into which a terminal including an engagement section is to be inserted, said housing being electrically insulative, said housing including;

a terminal space therein into which the terminal is inserted in a direction towards a front of said housing from a rear of said housing, a lance protruding in said housing towards an axis of said terminal space, and said lance being configured to engage to and disengage from the engagement section of the terminal;

a resilient support resiliently supporting said lance such that said lance is movable away from said axis; and a path through which a jig for disengaging said lance from said engagement section is inserted into said housing from the front of said housing towards said lance along said engagement section, wherein said resilient support has a slit communicating with said path and extending towards said lance from an entrance of said path; and wherein said path has a first space and a second space, said slit being located between said first space and said second space; and wherein said first space, said slit, said second space, and said terminal space are arranged within said housing in order as recited in one of a first direction from a top of said housing to a bottom of said housing or a second direction from said bottom of said housing to said top of said housing.

12. The housing as set forth in claim 11, wherein said slit extends to the engagement section of the terminal to be inserted into said terminal space or to a location in a vicinity of the engagement section of the terminal inserted into said terminal space.

13. The housing as set forth in claim 11, wherein said path and said slit are T-shaped or reverse T-shaped.

14. The housing as set forth in claim 11, wherein said lance includes an inclined surface higher in a direction towards the front of said housing from the rear of said housing, said lance being configured such that a jig inserted into said housing through said path makes contact at a front end thereof with said inclined surface of said lance.

15. The housing as set forth in claim 11, wherein said resilient support includes a surface facing an axis of said terminal space, said surface defining an inclined surface higher in a direction towards the rear of said housing from the front of said housing.

16. The housing as set forth in claim 11, wherein said resilient support is arranged to separate said first space of said path from said second space of said path, said slit being formed in said resilient support to allow said first space to communicate directly with said second space via said slit.

* * * * *